United States Patent [19]

Jenn

[11] Patent Number: 4,653,240

[45] Date of Patent: Mar. 31, 1987

[54] WATERFRONT STRUCTURE

[75] Inventor: Louis J. Jenn, Indianapolis, Ind.

[73] Assignee: Atrium Structures, Inc., Indianapolis, Ind.

[21] Appl. No.: 712,245

[22] Filed: Mar. 15, 1985

[51] Int. Cl.[4] ..... E02D 5/74

[52] U.S. Cl. ..... 52/169.2; 405/219

[58] Field of Search ..... 52/169.1, 169.2, 169.3; 114/264, 266, 267, 173; 405/218, 219, 116, 203

[56] References Cited

FOREIGN PATENT DOCUMENTS 2716481 4/1977 Fed. Rep. of Germany ..... 405/219

1431670 4/1976 United Kingdom ..... 405/219

OTHER PUBLICATIONS

"Baltimore Inner Harbor", Barton-Gillet Company, 1979.

*Primary Examiner*—Carl D. Friedman

*Assistant Examiner*—Naoko N. Slack

*Attorney, Agent, or Firm*—Woodard, Weikart, Emhardt & Naughton

[57] ABSTRACT

A waterfront structure including a plurality of structure segments each containing a plurality of business units, the structure segments being arranged in a U-shaped configuration and fronting and overlying a portion of a body of water. The free ends of the U-shaped structure are spanned by a connecting walkway. Each structure segment defines dual pathway segments therethrough forming dual pathways providing access between each of the business units. A portion of the waterfront structure is configured to resemble a ship docked at said waterfront structure.

2 Claims, 2 Drawing Figures

WATERFRONT STRUCTURE

BACKGROUND OF THE INVENTION

1. Field of the Invention:

The present invention relates generally to structural arrangements for business and entertainment facilities and in particular to such a structural arrangement located on a waterfront.

2. Description of the Related Art:

In recent years it has become popular to build retail shopping and entertainment facilities in aesthetically pleasing configurations, sometimes evoking a festival atmosphere. A particularly attractive arrangement involves business establishments located in proximity to a body of water. Examples are Mystic Bay in Connecticut, Harbor Place in Baltimore, and Portside in Toledo, Ohio. The present invention presents a novel waterfront structure providing business and entertainment facilities.

SUMMARY OF THE INVENTION

One embodiment of the present invention might involve a waterfront structure arranged with a plurality of individual business units wherein portions of the waterfront structure are facing a body of water. The waterfront structure includes a plurality of structure segments, each segment including a plurality of business units therein. Each segment defines a pathway segment therethrough such that each business unit of each structure segment in accessible from the corresponding pathway segment, the pathway segments communicating as a continuous pathway. The plurality of structure segments are disposed entirely over the body of water, and there is provided a plurality of land-connecting walkways communicating with the pathway and connecting the plurality of structure segments to the shore of the body of water.

DESCRIPTION OF THE PREFERRED EMBODIMENT

Figure 1:
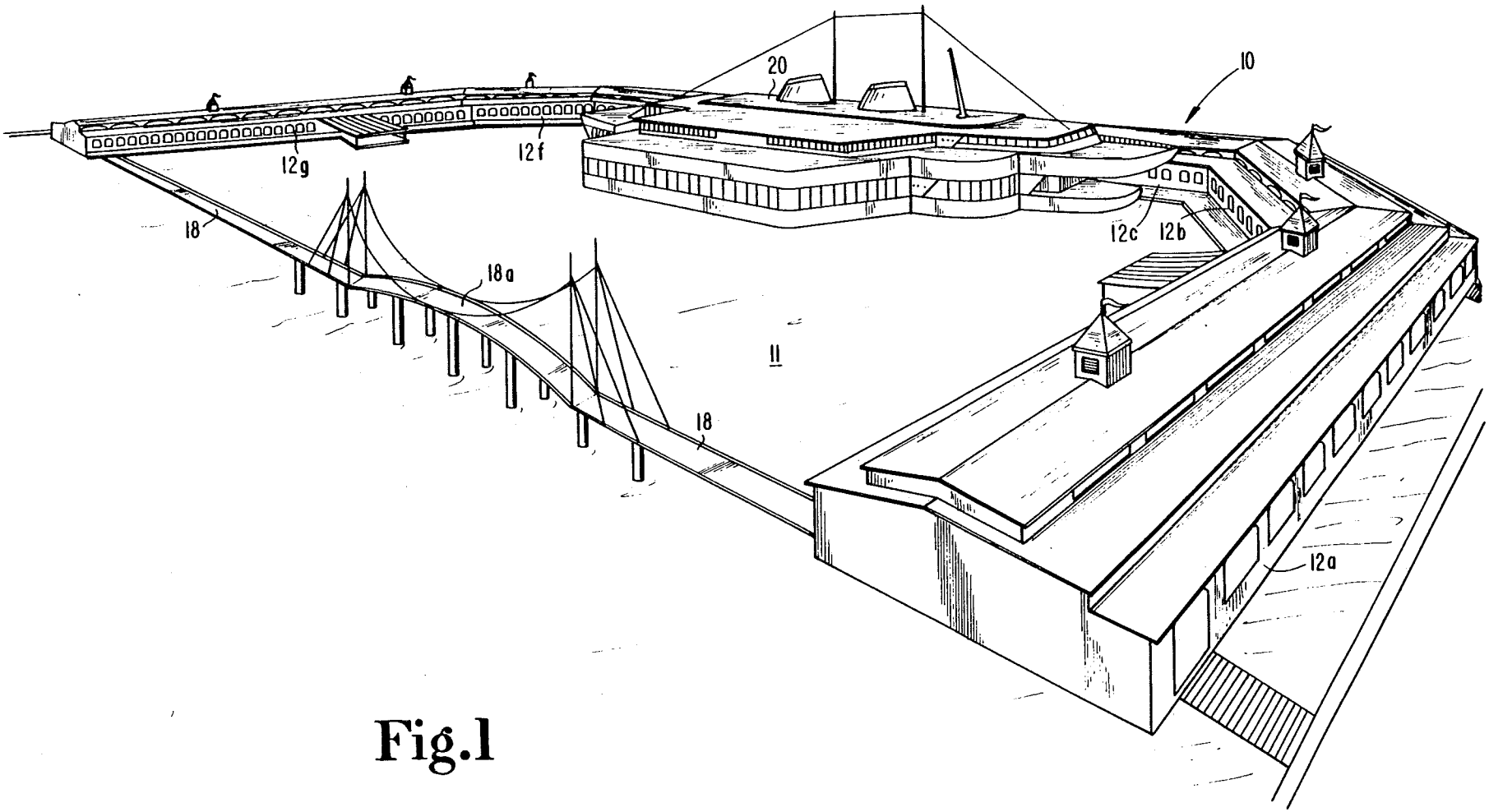
FIG. 1 is a perspective view of a waterfront structure in association with a body of water made in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Figure 2:
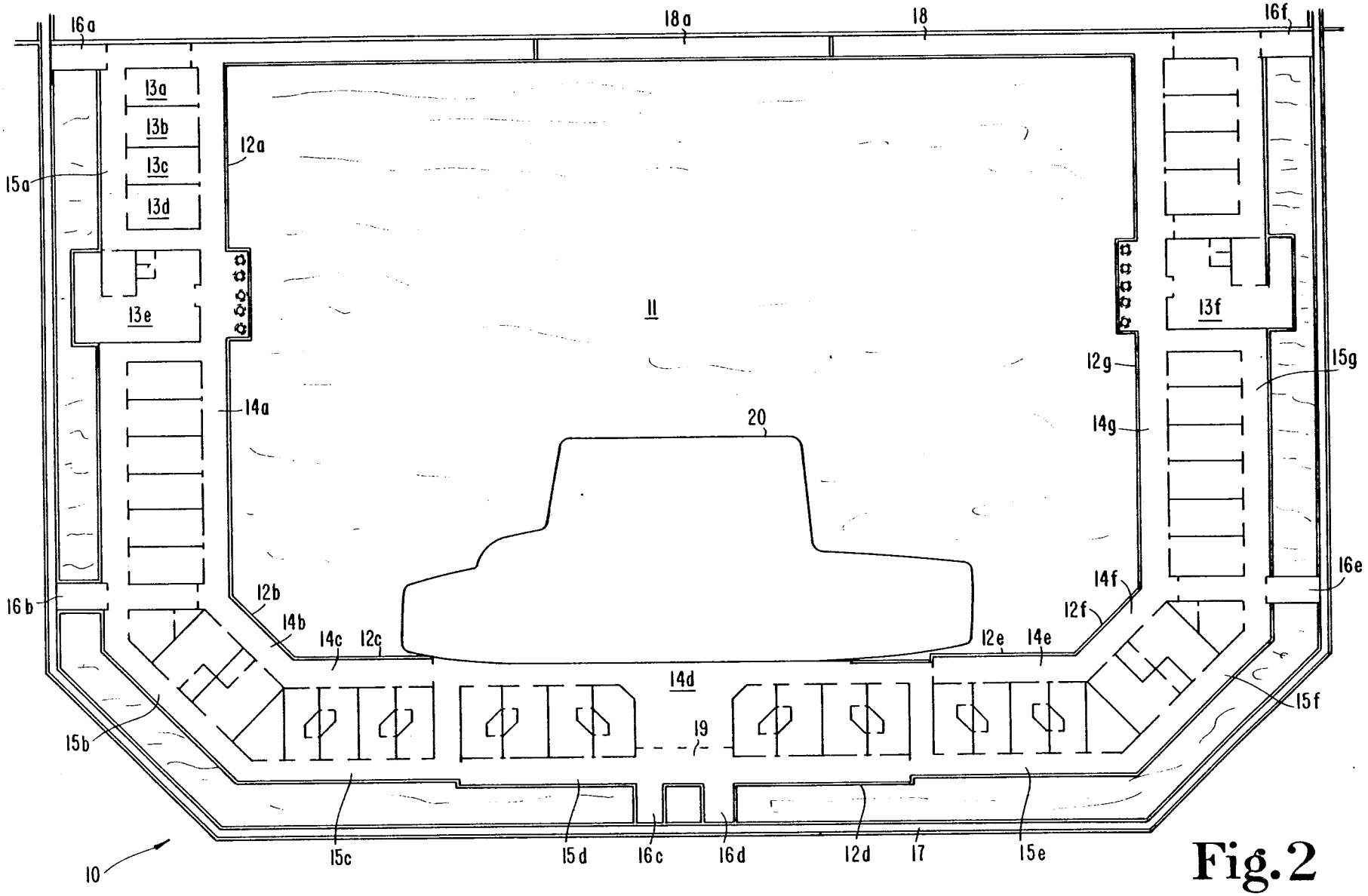
FIG. 2 is a floor plan view of the waterfront structure of FIG. 1.

Referring in particular to FIGS. 1 and 2, there is illustrated a waterfront structure 10 in accordance with the present invention. Waterfront structure 10 is associated with a body of water 11 which can be natural or man-made.

Waterfront structure 10 includes a plurality of structure segments 12*a*–12*g* connected end-to-end to provide a continuous structure. Each structure segment 12*a*–12*g* is arranged with a plurality of business units therein, such as business units 13*a*–13*d* in structure segment 12*a*. Business units 13*a*–13*d* and similarly arranged business units in each of the other structure segments are particularly suited for retail business use. Business units 13*e* and 13*f*, because of their locations and configurations, are particularly suited for restaurant use.

Each structure segment 12*a*–12*g* defines a corresponding pathway segment 14*a*–14*g* therethrough. Each business unit of each structure segment 12*a*–12*g* is accessible from the corresponding pathway segment of the structure segment, and all of the pathway segments 14*a*–14*g* are connected end-to-end such that every business unit is accessible from every other business unit via the intermediate pathway segments. It is preferred that pathway segments 14*a*–14*g* be in the form of an exterior boardwalk disposed between the business units and body of water 11.

Structure segments 12*a*–12*g* each also define second pathway segments 15*a*–15*g* therethrough. Pathway segments 15*a*–15*g* are connected end-to-end to provide an alternative pathway enabling access from every business unit to every other business unit. Pathway segments 15*a*–15*g* are disposed between the business units and the shore of body of water 11, and preferably are enclosed to provide protection from the weather for the patrons of the business units.

Structure segments 12*a*–12*g* are arranged in a generally U-shaped configuration wherein the internal sides of the U-shaped structure face and surround a portion of body of water 11. Structure segments 12*a*–12*g* are located offshore and overlie body of water 11. Therefore, land-connecting walkways 16*a*–16*f* provide access from the shore 17 of body of water 11 to the pathways formed by pathway segments 14*a*–14*g* and 15*a*–15*g*. A connecting walkway 18 spans the free ends of the U-shaped structure to provide a short cut pathway between the business units located near the free ends of the U-shaped structure. Connecting walkway 18 overlies body of water 11 and including bridge 18*a*.

Connected to structure segment 12*d* and accessible from main entry 19 and the pathways via pathway segments 14*d* and 15*d* and is an entertainment unit 20 which is located over body of water 11 and is configured to resemble a docked ship. Entertainment unit 11 is arranged internally to provide business and entertainment facilities.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. A waterfront structure associated with a body of water having a shoreline which is at least in part U-shaped, said waterfront structure comprising:

a plurality of structure segments, each including a plurality of individual business units therein, said plurality of structure segments disposed entirely over said body of water and arranged end-to-end in a U-shaped configuration substantially parallel to and proximate the U-shaped part of the shoreline of said body of water, each structure segment including:

a first pathway segment therethrough communicating with each of the individual business units therein, the first pathway segment being open and exposed to weather and disposed adjacent the body of water between the plurality of individual business units and said body of water, and a second pathway segment therethrough communicating with each of the individual business units therein, the second pathway segment being enclosed and protected from weather and disposed adjacent the body of water between the plurality of business units and the shore of said body of water, the first pathway segment of each structure segment communicating at each end with the first pathway segment of each of the next adjacent structure segments so as to define a first continuous pathway the length of said waterfront structure, the second pathway segment of each structure segment communicating at each end with the second pathway segment of each of the next adjacent structure segments so as to define a second continuous pathway the length of said waterfront structure;

a connecting walkway spanning said body of water between the free ends of the U-shaped configuration of structure segments and communicating with at least one of the first and second continuous pathways, the U-shaped configuration of structure segments and said connecting walkway thereby enclosing a portion of said body of water; and a plurality of land-connecting walkways communicating with at least one of the first and second continuous pathways and the shore of said body of water.

2. The waterfront structure of claim 1, and further including an entertainment unit configured to resemble a ship disposed on said body of water and connected to one of said structure segments, said entertainment unit being internally arranged to provide business and entertainment facilities.

* * * * *